US006765488B2

(12) United States Patent
Stanfield

(10) Patent No.: US 6,765,488 B2
(45) Date of Patent: Jul. 20, 2004

(54) ENHANCED CONSUMPTION CONTROLLER

(75) Inventor: James S. Stanfield, Santa Barbara, CA (US)

(73) Assignee: James Stanfield & Company, Santa Barbara, CA (US)

( * ) Notice: Subject to any disclaimer, the term of this patent is extended or adjusted under 35 U.S.C. 154(b) by 2 days.

(21) Appl. No.: 10/095,685

(22) Filed: Mar. 11, 2002

(65) Prior Publication Data

US 2003/0169172 A1 Sep. 11, 2003

(51) Int. Cl.[7] ..... G08B 23/00

(52) U.S. Cl. ..... 340/573.1; 340/425.5; 340/309.16; 340/309.4; 368/107; 368/89; 368/10; 368/113

(58) Field of Search ..... 340/573.1, 425.5, 340/309.16, 309.4; 368/107, 10, 89, 113

(56) References Cited

U.S. PATENT DOCUMENTS

| | | | | | |
|---|---|---|---|---|---|
| 4,218,611 | A | | 8/1980 | Cannon | 235/92 T |
| 4,311,448 | A | | 1/1982 | Strauss | 431/14 |
| 4,396,904 | A | * | 8/1983 | Hanaoka | 340/309.16 |
| 4,853,854 | A | | 8/1989 | Behar et al. | 364/413.01 |
| 4,862,431 | A | | 8/1989 | Drouin | 368/10 |
| 4,914,819 | A | | 4/1990 | Ash | 30/147 |
| 4,975,682 | A | | 12/1990 | Kerr et al. | 340/573 |
| D319,430 | S | | 8/1991 | Cheng | D13/168 |
| D335,460 | S | | 5/1993 | Tanaka | D10/40 |
| 5,365,496 | A | | 11/1994 | Tolan-Samilow | 368/109 |
| 5,421,089 | A | * | 6/1995 | Dubus et al. | 30/142 |
| 5,424,719 | A | | 6/1995 | Ravid | 340/573 |
| 5,563,850 | A | * | 10/1996 | Hanapole | 368/89 |
| 5,908,301 | A | | 6/1999 | Lutz | 434/236 |
| 6,473,368 | B1 | * | 10/2002 | Stanfield | 368/107 |

FOREIGN PATENT DOCUMENTS

| | | | |
|---|---|---|---|
| WO | WO93/04931 | 3/1993 | B65B/57/20 |

* cited by examiner

*Primary Examiner*—Daniel J. Wu
*Assistant Examiner*—Tai T. Nguyen
(74) *Attorney, Agent, or Firm*—Leon D. Rosen

(57) ABSTRACT

A portable device that helps a person control food consumption by slowing the eating process to a pace that provides time for the human brain to signal (through hormones such as Sulfated Cholecystokinin) a "sensation of fullness" before overeating or "binge eating" can occur, to normalize meal-time social behavior by encouraging relaxation and conversation when eating with others, and to control medical conditions including Bulimia and Anorexia. The apparatus includes red and green lights (22, 20), a circuit (46) that controls energization of the lights, and a pushbutton switch (42) that operates a portion of a circuit. When the push button (44) is depressed, the circuit energizes the red light (22) for a predetermined wait period such as 20 seconds (which can be varied), to indicate that the person should not eat. Then, the circuit energizes the green light (20), to indicate that the person can take one or two bites of food at his/her convenience. After taking one or two bites, the person depresses the push button to cause the red light to be energized. This cycle continues until the meal is over. A person can depress a button (80) to place the device in a "fast start" adaptive mode, wherein the wait period when the red light is on, gradually increases from a short period such as 7 seconds to 20 seconds during a time such as three minutes, and then continues at 20 second periods for the rest of the meal.

6 Claims, 4 Drawing Sheets

ENHANCED CONSUMPTION CONTROLLER

BACKGROUND OF THE INVENTION

Research shows that eating too fast has adverse effects for persons who are trying to maintain or lose weight, as well as in discouraging interaction of family members at a dining table. The brain has an ability to control a feeling of fullness, which is sometimes referred to as the "appestat". This is accomplished by a brain mechanism that releases hormones such as Sulfated Cholecystokinin (CCK) that controls food intake by informing the person that he/she is full or has had enough to eat. This is in addition to information from the stomach that it is no longer empty after perhaps a few minutes of eating. The research shows that it takes approximately 20 minutes from the time we first start eating, for the "appestat" to signal us that we are full or have had enough to eat. If we eat too fast we consume more food than is necessary before the "appestat" goes off and informs us that we are full.

Another consequence of eating too fast, is that it reduces conversation among persons at the table, such as family members. That is, if people leave considerable time between taking bites of food, this provides a more relaxed "social atmosphere" at the dining table. Such a more relaxed atmosphere encourages table conversation. It is noted that in the case of children, studies show that increased conversation at the dining table increases children's reading competency. A device that was easy and comfortable for persons to use, and which slowed the eating process so as to leave more time for the person's brain to signal that he/she is full and to provide a relaxed social atmosphere that encourages social interaction such as conversation at the dining table, would be of value.

Research results suggest that the eating pace of thin people is different from that of obese people, especially during the first half of the meal. Thin people tend to eat faster during the first half of the meal and then slow down. Obese people tend to eat at the same pace throughout the meal, with the pace often being faster for the obese people throughout the meal and resulting in their eating more. A device that controlled the eating pace for those who need help in maintaining or losing weight, so the pace was closer to that for thin people, may be especially effective. Such control would be especially effective if it resulted in a pace that satisfied an overweight person who was hungry or upset when the person started the meal.

SUMMARY OF THE INVENTION

In accordance with one embodiment of the present invention, an apparatus and method are provided for controlling consumption behavior, while also providing a more relaxed dining environment to enhance conversation. The apparatus includes an OK indicator such as a green light that indicates that it is all right to consume, a STOP indicator such as a red light that indicates that it is not permissible to consume, a push button switch, and an electronic circuit. When a person takes one or two bites of food, the person depresses the push button, causing the red light to be energized for a predetermined "wait" or "no-eat" period on the order of magnitude of 20 seconds (usually 10 to 30 seconds), after which the green light is automatically energized. The green light remains lit while the person decides to take one or two bites of food and then depresses the push button to repeat the cycle. The person has an unlimited period during which the green light is lit, so the person can carry on a conversation and take one or two bites at his/her leisure.

The apparatus includes a timer that displays time in seconds and minutes. When an on-off switch is switched on, the timer begins to show the elapsed time from when the switch was tripped. Starting the timer also energizes the green light, which is switched to red when the push button is depressed. The person is advised to try to extend the eating time to at least 20 minutes. This provides time for the "appestat" in the person's brain to signal the person that he/she is full. The person can view a timer that shows elapsed time since the beginning of the meal (or time to the end of 20 minutes), which encourages the person to wait until taking a bite of food. The display of total elapsed allows the person to judge their overall "eating speed rate,"

The green and red lights are preferably "LEDs" (light emitting diodes) which are energized from a battery in the portable apparatus. The time that the red light is on, when the person should not eat, can be manually adjusted by the user. The user is encouraged to begin with a comfortable no-eating (red light) period and, over a period of days or weeks, to gradually increase the length of the no-eating period, to a minimum of 20 seconds and preferably longer.

If the person believes he/she cannot wait the full wait period such as 20 seconds or wishes to eat as a thin person does, then the person operates a "fast start" switch. The apparatus then provides a shorter wait period such as 7 seconds. However, the length of the wait period gradually increases, as to 20 seconds after 3 minutes.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
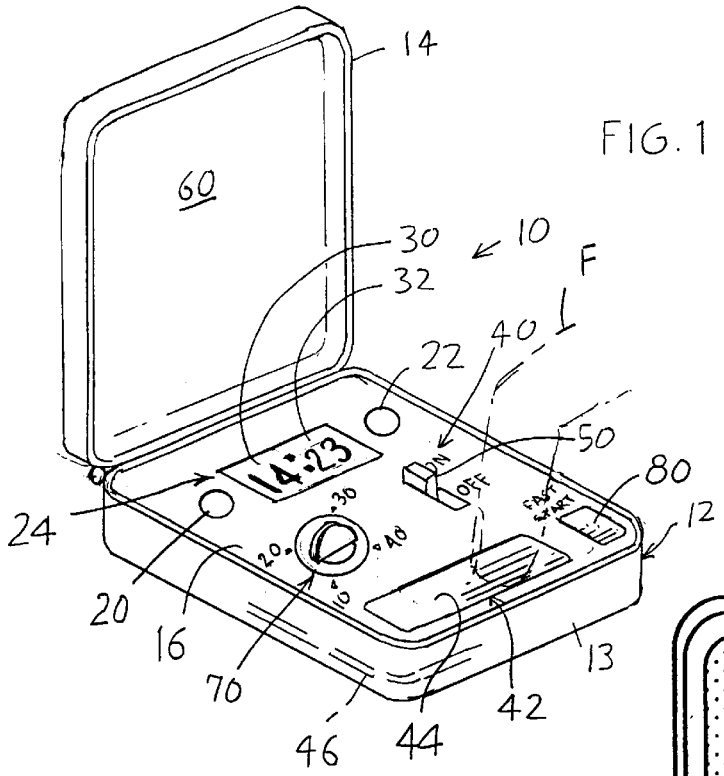
FIG. 1 is an isometric view of a consumption controller apparatus constructed in accordance with the invention, with the cover opened about 90° from a closed position.
Figure 2:
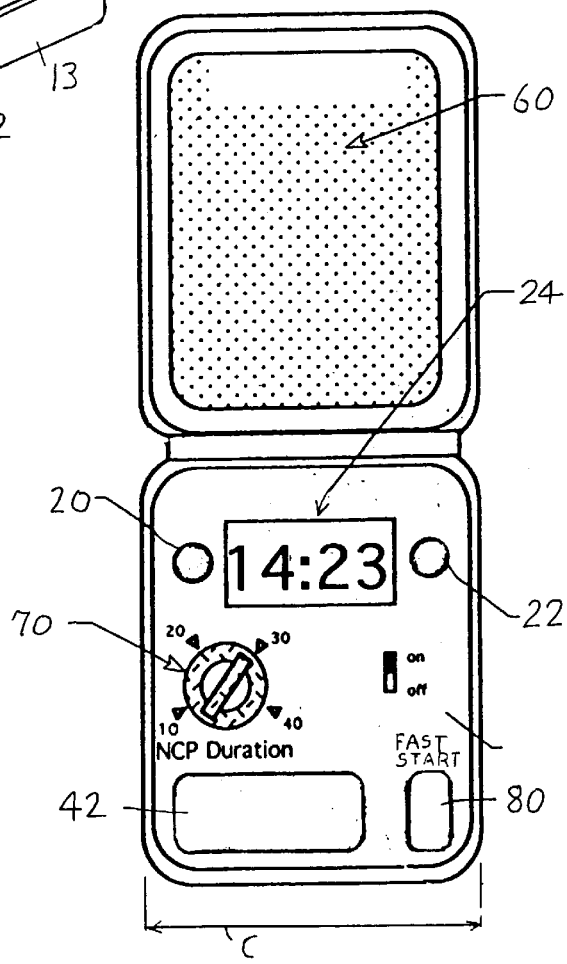
FIG. 2 is a plan view of the apparatus of FIG. 1, with the cover opened about 180° from a closed position.
Figure 3:
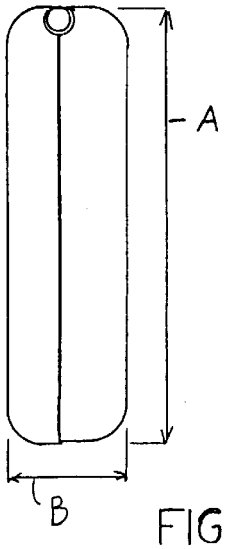
FIG. 3 is a side elevation view of the apparatus of FIG. 1, with the cover fully closed.

FIG. 1 illustrates a portable consumption controller, or device 10 which a person can choose to use to control his consumption behavior. The device includes a frame 12 with a base 13 that contains displays and controls, and a cover 14 that can cover a top surface 16 of the frame. The frame includes a green light 20 in the form of an LED (light emitting diode) that emits a steady green light, a red light 22 in the form of an LED that emits a steady red light (although it could be made to flash), and a timer display 24 that has a left portion 30 that displays minutes and a right portion 32 that displays seconds. An on-off switch 40 is used to turn on the apparatus. A push button switch 42 has a push button 44 that controls operation of the device, or apparatus. A circuit 46 that includes a circuit board and circuitry thereon connected to the LEDs and display and the switches, lies within the frame.

To activate the apparatus, a person slides a slide actuator 50 of the on-off switch 40. The green light at 20 is then displayed, with the circuit energizing the green LED so it blinks off perhaps every 2 seconds. The blinking green light continues to be displayed indefinitely, until a person depresses the push button 44 to activate the switch 42. As soon as the push button is depressed, the green light 20 is no longer displayed, but the red light at 22 is displayed by the circuit energizing the red LED. The red light remains on for a predetermined period of time on the order of magnitude of 20 seconds. After that predetermined time period, the red light is automatically deactivated and the blinking green light 20 is automatically activated for an indefinite period until the user is ready to eat again; after a bite or two, the user depresses the push button 44. The finger F of a person is indicated to show the push button being depressed.

The device comes with instructions, which may be printed on the bottom of the base or on the inside of the cover. The instructions remind the operator how the device is to be used. Whenever the green light is on, the person is free to take one or two bites of food, but no more. Immediately after the one or two bites (limited time consumption), the person must depress the push button 44, which causes the red light to light. The red light time period of perhaps 20 seconds is a "time-out" or "no-eat" period, and the person must not consume food so long as the red light is on. However, when the green light comes on again, the person is free to conduct limited consumption (one or two bites), and then must again depress the push button. While the green light is on, the person can wait as long as he/she wishes before consumption (one or two bites).

From the time that the device is activated by moving the slider switch activator 50, the timer display 24 displays the elapsed time. That is, the timer shows the number of seconds and minutes from the time the device was activated and the meal begins. The term "meal" is defined as the food served at the beginning of eating and does not include any second helping or dessert. The instructions advise the person to try to extend the meal to at least 20 minutes. As mentioned earlier, this will provide time for the "appestat" in the brain to signal the person that he/she has had enough to eat. As the person occasionally glances at the timer display 24, the person is encouraged to let the green light remain lit and not take a bite until the person thinks it is appropriate. Thus, the combination of the red light which controls non-eating periods, the green light which assures the person he has unlimited time to take one or two bites, and the timer that shows the progress the person has made in delaying full meal consumption, helps the person to consume the meal at a more leisurely pace. The leisurely pace, with red light time-outs followed by possibly longer periods of green light during which the person can delay a bite as long as he/she wishes, promotes social interaction among family and friends by encouraging conversation or other social interaction if the meal occurs in a group.

The time-out or STOP period on the order of 20 seconds during which the red light 22 is lit, provides a mandatory period of non-consumption. Even if the person wishes to eat in a "binge" fashion, the red light orders the person to not eat for at least the predetermined period of perhaps 20 seconds. If the person is in a compulsive state, this helps the person stay in control, especially because the person knows that each STOP period is of limited duration.

The apparatus includes a manual-adjust variable time control 70. This control enables a person to set the predetermined time during which the red light STOP indicator is on. This period may be referred to as the non-consumption period indicated by the letters NCP. In the example shown, the control can be set between 7 and 40 seconds. However, the person is instructed to make adjustments only after trying a particular time through several cycles. The goal of the person is to finish the meal at or after 20 minutes have appeared on the timer display.

Although it would be possible to continually energize the green light 20 whenever it is supposed to be on, applicant finds that persons sometimes stop paying attention to the green light and fail to depress the push button 44 when they take one or two bites. To avoid this, applicant blinks the green light 20 off, as by turning off the green light for ½ second every two seconds, so the person continues to realize that the green light is on. Applicant prefers that the green light be energized at least once every 10 seconds and preferably at least once every 5 seconds so a person can glance at the light and see whether or not he can take a bite. Similarly, applicant prefers that the red light be energized at least once every 5 seconds, preferably continuously, during a stop period.

Figure 4:
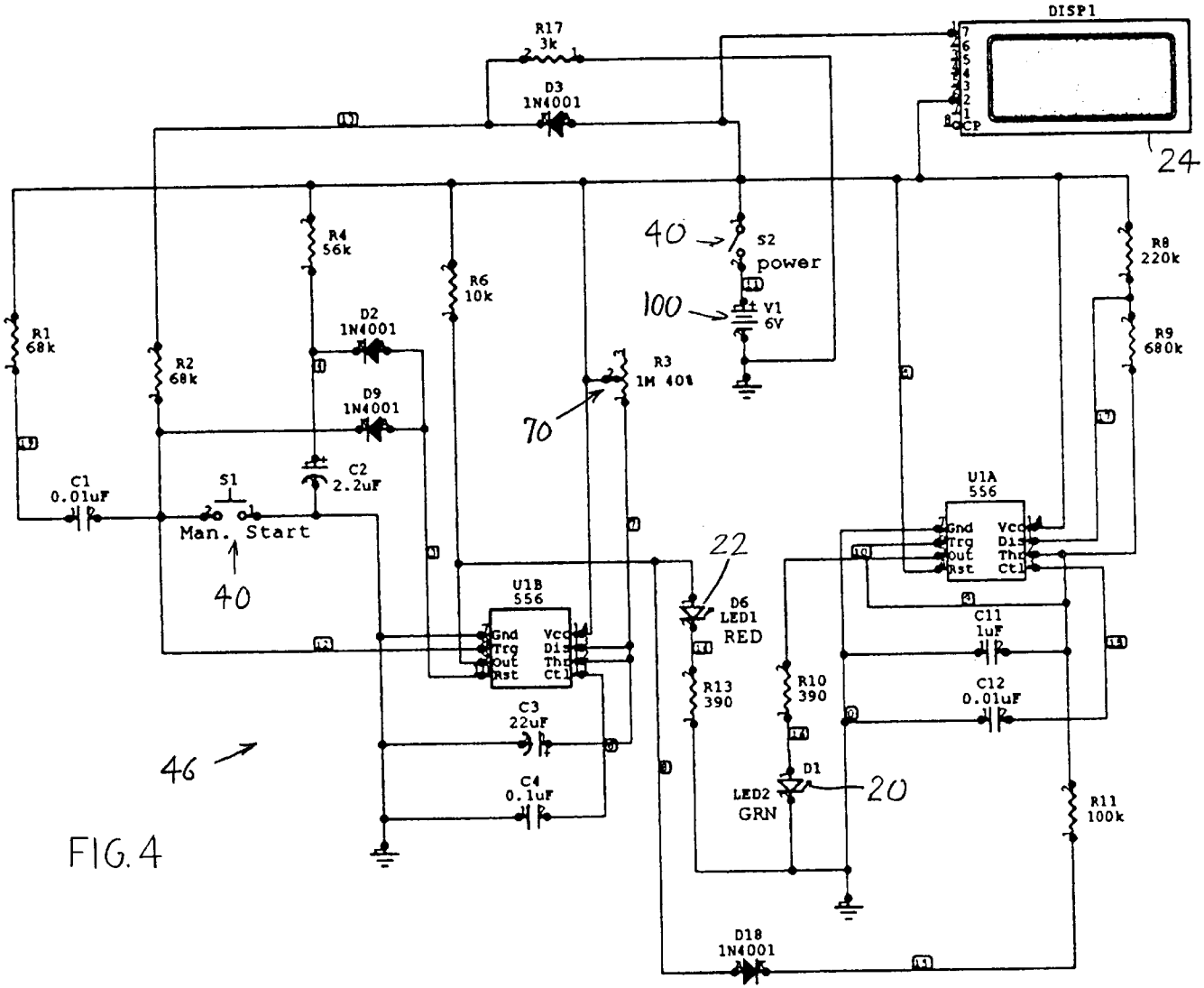
FIG. 4 is a schematic diagram of a circuit of the apparatus of FIG. 1. The letter and number designations beside circuit components are the standard designations of those components.

FIG. 4 is a schematic diagram of the circuitry 46. The circuitry includes three AAA batteries 100 and other parts labeled according to the parts shown in FIG. 1.

Applicant has constructed and tested a prototype of the apparatus of the type illustrated in FIGS. 1–4. In the compacted configuration, the device has a height A of 2.5 inches, a thickness B of 0.7 inch, and a width C of 2.0 inches. This enables the device to be carried in a pocket until used at a meal.

The control of rate of eating can be useful not only in reducing or maintaining weight, but also to avoid certain medical problems. People who eat too fast tend to swallow air which can cause physical discomfort. Eating too fast can aggravate indigestion. The device for controlling eating can be used to control binge eating, and has application in the treatment of Bulimia, Anorexia and Bulimarexia. The device has a calming effect that reduces stress.

Although the apparatus is designed especially for controlling consumption of food, it also can be used to modify other consumptive behavior, especially smoking of cigarettes and consumption of alcohol. In controlling cigarette smoking, the red light can indicate that the person cannot take a puff from his/her cigarette, and the red light may be on for a longer period of time than is used for eating. For cigarette smoking, the person is "authorized" to take a puff whenever the green light is on, and is instructed to depress the push button 44 immediately after he/she takes a puff.

The presence of an attractive device that has an interesting display, encourages a person to follow the "dictates" of the device. Bright, electrically energized green and red lights, which are commonly associated with "go" and "stop" in traffic lights, help a person surrender behavior to the device. The simple pushbutton switch makes it easy for the person to indicate, to the device, that the person has completed a consumption step. The clear timer display, which starts counting time automatically when the device is put into use, provides instant and convenient feedback as to time passage and encouragement by an official-looking timer (compared to a person timing himself/herself with a watch).

When first introduced to the device, some people are uncertain as to how they should shape their eating rate from fast to a normal pace. For this group, applicant has included an automatic track which controls the eating pace of the entire meal and which emulates the variable pace of thin people, as established by medical research. Applicant provides a manually operated switch 80 that is labeled "Fast Start" and which can be depressed to begin a fast start cycle. When the switch 80 is depressed, the green light is energized until the button 44 is depressed to energize the red light. The red light then stays on for a short period of time such as 7 seconds, before the green light is again displayed. This 7 second no-eat period might repeat during the first two minutes of operation or for a few cycles (of red and green) and then may gradually increase to a period of 20 seconds after 5 minutes (or after perhaps 15 cycles). Thus, the stop period, which continues as long as the red light is displayed, generally increases in length with repeated displays of the OK-to-consume indications. There may be two or three stop periods of the same length before the final stop period (e.g. 20 seconds) is reached after perhaps 5 minutes.

As mentioned above, the fast start cycle mimics the eating habits of thin people who take bites at short intervals early in a meal, and then take bites at longer intervals as they are no longer so hungry. A person who wishes to use the fast start automatic option, may continue with it or switch at any time to the manual control mode which allows the person to individually customize the pace by selecting the precise duration of the no-eating (red light) period. The device leaves the fast pace mode and enters the custom mode by the person pressing (once or twice) on the Fast Pace button.

Figure 5:
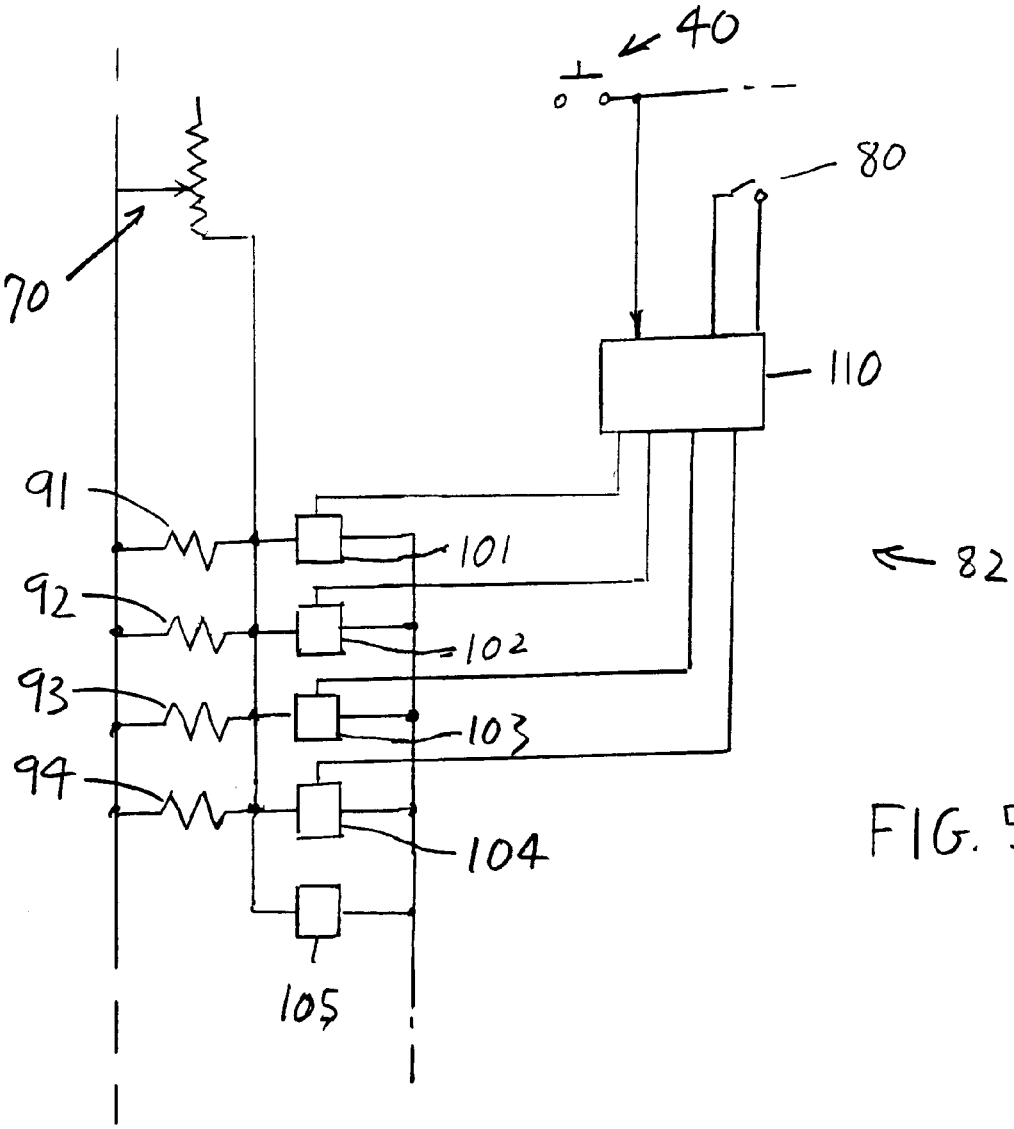
FIG. 5 is a simplified schematic diagram of a subcircuit for implementing the fast start option of the apparatus of FIG. 1.

The short "time-out" or "no-eat" period in the fast start mode can be as short as 5 seconds, and the eventual maximum period of time can be up to 100 seconds long. FIG. 5 shows a circuit portion 82 that changes the stop period by changing the resistance in the capacitor-resistor timing circuit of FIG. 4. Instead of, or in addition to the variable timing circuit 70 of FIG. 4, FIG. 5 shows four different resistors 91–94 connected by gates 101–104 to the capacitors. When the switch 80 is closed, the circuit part 110 closes the first gate 101. Every time a signal is received from closing of switch 40, the circuit part 110 closes another gate such as 102 and opens the others. Finally, only gate 105 is closed and only the resistance at 70 controls the stop period.

Figure 6:
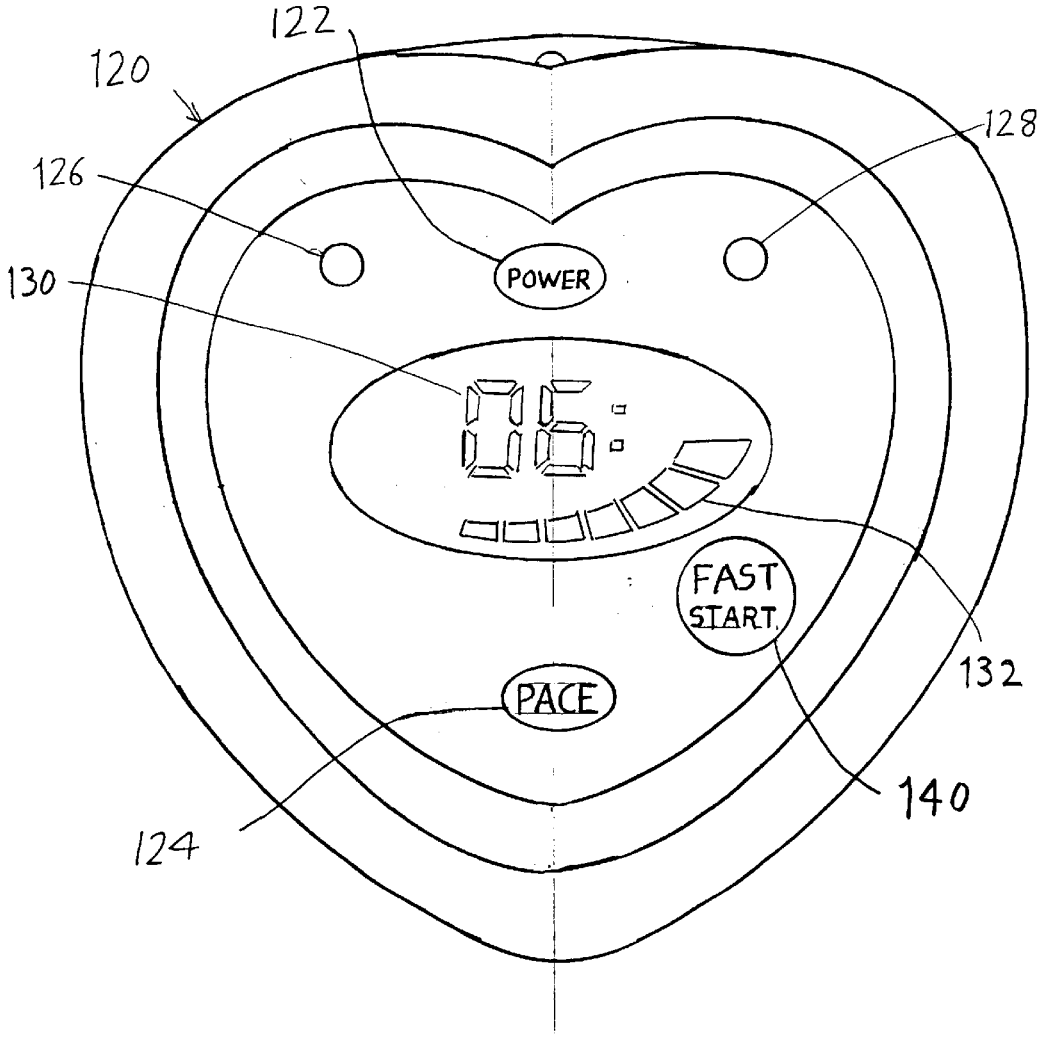
FIG. 6 is a plan view of a consumption controller of another embodiment of the invention.

FIG. 6 illustrates the most advanced consumption controller that applicant has designed and built. The controller frame 120 is in the form of a heart to indicate the heart improvement benefits. It has a maximum length and width of about 3 inches each. A person depresses the power button 122 to turn on or shut off the device. Depressing a PACE button 124 causes deactivation of a green LED 126 and activation of a red LED 128 (for e.g. 20 seconds). The elapsed time is displayed at 130 in the center area. A series of seven lights 132 indicates how much longer the red light will remain on. For example, if the wait period is 21 seconds then the leftmost (thinnest) light 134 is illuminated 3 seconds after the beginning of the wait period. Additional lights are energized every 3 seconds until all seven are energized briefly at 21 seconds.

The manual-adjust time control is accessed by pressing the power button 122 and holding it down for 5 to 10 seconds. When this happens, the device goes into a "pace selection mode" wherein the user releases the power button and then depresses once for each second he wants in the no-eating mode. Thus, fifteen depressions of the power button results in a 15 second no-eating period.

To achieve a fast start, a person turns on the controller and depresses the Fast Start button 140. The fast start process is as described above.

Thus, the invention provides an apparatus for behavior controlled consumption, especially in eating, which is portable and easy to use. The apparatus includes an OK indicator that displays an OK-to-consume indication that is preferably a green light, and a STOP indicator that produces a stop indication that indicates it is not permissible to consume, and that is preferably a red light. A push button switch has a push button that is depressed by the person after each consumption. An electronic circuit turns on the STOP indicator for a predetermined time period whenever the push button is depressed, and after the predetermined time period the circuit controls the displays to display the OK indicator as by illuminating the green light. The apparatus also includes a timer that counts up (it could be constructed to count down) the time when an on-off switch was turned on to begin the sequence. The apparatus includes a fast start switch that can be manually operated to produce initial short STOP periods which gradually increase in duration.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for control of consumption, which includes an operable OK indicator that produces an OK-to-consume indication and a STOP indicator that produces a STOP indication that it is not permissible to consume, a manually operable switch, and a circuit that operates said STOP indicator to produce a STOP indication during a controlled stop period of time after said switch is operated and which then operates said OK indicator until said switch is operated, including:

a manually operable fast start control;

said circuit includes a fast start circuit portion that, when said fast start control is manually operated, initially establishes a short stop period and generally increases the duration of said short stop period after said OK indicator is operated, until a maximum stop period is reached.

2. The apparatus described in claim 1 wherein:

the duration of said short stop period repeatedly increases until a maximum stop period is reached which is at least twice said short stop period.

3. The apparatus described in claim 1 including:

a display that indicates the time remaining until the end of the stop period.

4. The apparatus described in claim 1 wherein:

the duration of said initially established short stop period and the increases in the durations of said gradually increased stop periods are variably settable.

5. Apparatus for behavior controlled consumption comprising:

a frame;

an on-off switch and a control switch, each switch being mounted on said frame;

an OK indicator that produces an OK-to-consume indication that indicates it is permissible to consume, and a STOP indicator that produces a stop indication that indicates it is not permissible to consume, each indicator mounted on said frame;

an electronic circuit mounted on said frame and coupled to said switches and to said indicators, said circuit being constructed to energize said OK indicator to display an OK-to-consume indication after said on-off switch is turned on and to continue to display said OK-to-consume indication until said control switch is manually operated;

said circuit is constructed so when said control switch is operated said circuit energizes said STOP indicator to display a STOP indication for a predetermined stop period of time, and at the end of said predetermined stop period said circuit energizes said OK indicator to display said OK-to-consume indication until said control switch is again operated;

said OK indicator is constructed to display said OK-to-consume indication at least once every 10 seconds from the end of said predetermined stop period until said control switch is again operated, and said STOP indicator is constructed to display said STOP indication at least once every 5 seconds between the time that said control switch is operated and the end of said predetermined period;

a fast start control constructed for manual operation;

said electronic circuit includes a fast start circuit portion which initially establishes a short stop period that generally increases in length with repeated displays of said OK-to-consume indications upon operation of said fast start control.

6. A method for slowing the eating process comprising:

during the eating of a meal that has a beginning, providing alternate OK-to-consume indications that indicates it is permissible to consume food, and STOP indications that indicate that it is not permissible to consume food;

said step of providing indications that is not permissible to consume food, includes providing STOP indications each of a short duration near the beginning of the meal and providing STOP indications of longer durations following the STOP indications of short durations;

said step of displaying STOP indications includes beginning to display a STOP indication every time a push button switch is depressed, and ending the display of the STOP indication at the end of the duration of the corresponding STOP indication.

* * * * *